US005628463A

United States Patent [19]

Nakamura

[11] Patent Number: 5,628,463

[45] Date of Patent: May 13, 1997

[54] VAPOR IONIZING DISCHARGER APPARATUS

[75] Inventor: Yasunori Nakamura, Tokyo, Japan

[73] Assignee: Colcoat Co., Ltd., Tokyo, Japan

[21] Appl. No.: 426,381

[22] Filed: Apr. 21, 1995

[30] Foreign Application Priority Data

Apr. 27, 1994 [JP] Japan ..... 6-110146

[51] Int. Cl.[6] ..... B05B 5/00

[52] U.S. Cl. ..... 239/690; 239/526; 239/366

[58] Field of Search ..... 239/3, 706, 690, 239/691, 708, 526, 525, 364–366, 373

[56] References Cited

U.S. PATENT DOCUMENTS 3,122,320 2/1964 Beck et al. ..... 239/3
3,933,285 1/1976 Wiggins ..... 239/3 X
3,934,055 1/1976 Tamny ..... 239/3 X
4,629,119 12/1986 Plunkett et al. ..... 239/3 X
4,792,092 12/1988 Elberson et al. ..... 239/3

FOREIGN PATENT DOCUMENTS 5-47488 2/1993 Japan .
421811 12/1934 United Kingdom ..... 239/3

*Primary Examiner*—Kevin Weldon
*Attorney, Agent, or Firm*—Oblon, Spivak, McClelland, Maier & Neustadt, P.C.

[57] ABSTRACT

A removal of static electricity from a conductive coating can be used in an electrostatic coating system. A conductive liquid is atomized or formed into droplets and supplied to an electric insulating vessel. A supply port is thereby insulated from a stored liquid surface by making use of electric insulation characteristics of air. The liquid is atomized and ionized while applying a high voltage to the liquid storage system, and sprayed onto a charged article to discharge it.

9 Claims, 3 Drawing Sheets

VAPOR IONIZING DISCHARGER APPARATUS

BACKGROUND OF THE INVENTION

1. Field of the Invention

The present invention relates to an apparatus for atomizing and ionizing a conductive liquid, which enables direct application of a high voltage to a liquid system. The present invention is applicable to all industries subject to disasters and troubles caused by static electricity, and coating industries which desire to improve the environment by using a water coating.

2. Description of the Related Art

Measures for static electricity control in industrial fields are known. However, at present, risks of disasters and troubles remain due to changes in materials and production and processing steps and uses of plastics. The primary measures for such static electricity control include a lowering of electric resistance of materials for products, the use of antistatic agents, an increase of environmental humidity, a suppression of production speed, use of a discharge and self-discharging type discharger, and grounding.

Among these, a discharge type discharger for ionizing air to irradiate and neutralize a charged object is relatively easily installed in various production processes. This discharger is widely used for the reasons that an object to be irradiated is not damaged, and the charger is simple in maintenance and is relatively inexpensive.

The discharge type discharger may be a DC high voltage type. The DC system has a large irradiation distance but has a drawback in that, since either a positive or a negative ion is produced, the object to be discharged may be charged in reverse polarity depending on the irradiation time. It is also difficult to set up a suitable irradiation time in the DC system.

For these reasons, an AC system which has no limitation as to the irradiation time is the leading discharging system. However, the AC system also has disadvantages. There is a limitation as to the range for ion generation. An effective amount of ions can be delivered over only a short distance, say 3 cm. Discharge of a charged object spaced 3 cm or more is reduced to half, and when spaced 10 cm or more, almost no discharge is effected. Further, it is difficult to discharge a charged object which moves at a speed of 30 cm/sec or more even when it is within 3 cm of the irradiation source.

In the coating industry, use of electrostatic coating systems has been steadily increasing. Electrostatic coating systems include air atomizing systems, airless atomizing systems, and electrostatic atomizing systems, various ones of which are used depending on the required characteristics. Liquid coatings may generally be divided into a solvent type and a water type.

The water type is now widely used in consideration of environmental pollution. Since the electric resistance of the water coating is roughly of from $10^4$ to $10^5$ Ω·m, when coating is carried out by an electrostatic coating system which uses a solvent type coating, grounding is made via a coating route from a high voltage generator, whereby the voltage drops to the extent that electrostatic coating is not adequately performed. For this reason, in the case of electrostatic coating, components such as a coating tank and a coating pump are electrically insulated, posing a problem of electric insulation.

When a conductive coating is applied by cup-type or disk-type electrostatic coating machines which are of the electrostatic atomizing type, the electrostatic atomization becomes disabled since the high voltage power supply is grounded. An air atomizing type electrostatic coating machine is a system in which a coating is jetted and atomized from a nozzle using a compressed air flow, and a high voltage is applied to a needle electrode provided at the tip of a nozzle to generate a corona, thereby ionizing coating particles. In this system, a water coating which is relatively high in electric resistance can be used. However, if resistance is low, a coating tank system needs to be electrically insulated.

It is known that ionized air generated by a discharge in air is brought into contact with vapor-like fine droplets jetted out of a nozzle to obtain a charged vapor, and the vapor is brought into a clean room to enable discharging (Japanese Patent Laid Open No. 47488/1993). This method uses a high frequency (1 KHz) AC power supply and charges vapor indirectly, so that power consumption becomes high. Furthermore, the discharge electrode tends to be contaminated, requiring troublesome maintenance.

On the other hand, in the production process, movement is speeded up with the enhancement of production efficiency. In particular, discharge of a charged substance which moves at a high speed has been desired.

SUMMARY OF THE INVENTION

It is an object of the present invention to provide a discharger of static electricity device which can quickly perform discharging even when a discharger is spaced from a charged substance or even when a charged substance is moving at a high speed. This object can be achieved by incorporating ions generated from a discharger into mist-like water droplets instead of air, and by generating a sufficient amount of ions.

It is a further object of the invention to employ a direct ionizing system of coating particles instead of a conventional system for indirectly ionizing.

According to a first feature of the invention, a vapor ionizing apparatus for ionizing a conductive liquid, comprises an electrically insulating vessel containing a reservoir of an electrically conductive liquid, means for atomizing conductive liquid from the reservoir and means for applying a high voltage to the liquid in the atomizing means such that the liquid is simultaneously ionized and atomized.

The high voltage may be supplied to the atomizing means which may comprise a spray gun, and the means for applying a high voltage to the atomizing means may comprise a high voltage power supply operatively connected to the spray gun.

According to another feature of the invention, a vapor ionizing apparatus for ionizing a conductive liquid comprises an electrically insulating vessel containing a reservoir of an electrically conductive liquid, means for supplying conductive liquid to the vessel such that the conductive liquid in the supplying means is electrically insulated from the conductive liquid in the reservoir by air, means for atomizing conductive liquid from the reservoir, and means for applying a high voltage to the liquid in the atomizing means.

The supplying means may comprise a conductive liquid nozzle mounted above a surface of the reservoir for spraying the conductive liquid into the vessel or a conductive liquid port mounted above the surface of the reservoir for dripping the conductive liquid into the vessel. A spreader may be provided in the vessel for spreading the dripping conductive liquid.

According to yet another feature of the invention, a vapor ionizing apparatus for ionizing a conductive liquid comprises a plurality of electrically insulating vessels, each containing a reservoir of an electrically conductive liquid, means for supplying conductive liquid to the vessels such that the conductive liquid in the supplying means is electrically insulated from the conductive liquid in the reservoir of each of the vessels, atomizing means, means for selectively supplying conductive liquid from the vessels to the atomizing means, and means for applying a high voltage to the liquid in the atomizing means.

The atomizing means may comprise a spray gun and the means for selectively supplying conductive liquid from the vessels to the atomizing means may include a separator which can selectively connect conductive liquid in the vessels to the spray gun.

When water or a conductive coating liquid applied with an AC current of high voltage is atomized by using supersonic vibrations or by a spray nozzle using compressed air or the like, a positively and negatively charged mist is produced. As compared with an indirect method such as ionizing air with corona discharge and subsequently ionizing liquid droplets by the ionized air, the thus formed mist shows a markedly larger charge amount of ions with the same power consumption, and ozone is not generated. There results an excellent discharge effect or an excellent adhesion effect to a surface to be coated, using an inexpensive device.

As a conductive liquid used in the apparatus of the present invention, normal city water having a resistivity of from 0.1 to 10KΩ·m and ultrapure water having a resistivity of from 100 to 1000KΩ·m can be used depending on the purpose of use. For the purpose of discharge within a room, city water will suffice. Since bacilli or microorganisms are sometimes present within a water storage tank, it is preferred, in order to prevent this, that the tank be diligently washed and cleaned, and an additive with a drug or silver ion contained therein be added.

The apparatus according to the present invention is suitable for removing a surface charge from film, paper, cloth, yarn, etc. which runs while being wound or rewound. The apparatus is also suitable for discharge of products immediately after a plastic molding operation such as injection molding or compression molding. The apparatus is further suitable for neutralization discharge of a stationary article or an article subjected to pressing, peeling and friction, for example a charged vinyl plate polished in a multi-hot press operation for the purpose of polishing a rigid vinyl chloride plate. Examples of the stationary articles include production of comics and animations which involve pasting or sticking on films, paper and the like within a dry room, exhibiting a great electrostatic effect. Water used at that time is city water. Adhesion of water droplets onto the surface of a charged substance by ionized mists can be prevented by making the droplets of water or conductive liquid fine.

Further, in the case of jetting of high pressure washing water, sea water, coating or the like, and of releasing of aqueous vapor, liquefied gas, condensed carbon dioxide and other pressurized gases from a nozzle or a flange, static electricity is generated by friction, collision and disruption. The apparatus according to the present invention can be also applied to the discharge in the field as described. The apparatus of the present invention can be further applied to the discharge of static electricity generated during the transport by a duct, a conveyor and the like or introduction into a vessel of powdery particles such as plastic powder, metallic powder, grains and the like. For example, a silicon wafer to be a substrate for a semiconductor is washed under high pressure with ultrapure water, and the wafer is sometimes comparatively charged at that time. A charge of high pressure static electricity is also generated by rubbing an oriented membrane at the time of production of a liquid crystal display. Ultrapure water should be used for neutralization discharge of such a charged silicon wafer or rubbed oriented-membrane.

Since semiconductors such as IC's and LSI's are extremely sensitive to dust or the like, the production thereof is carried out in an air-conditioned clean room in which the great enemy is the generation of static electricity. Semiconductor devices have a trend to be further miniaturized, and are very sensitive to static electricity. Therefore, an ionizer for air has been heretofore used. The apparatus according to the present invention can be also used for a field of the kind as described. However, when water used at that time contains impurities, dust or the like is caused thereby, and water having a purity at a level called ultrapure water is preferably used.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DESCRIPTION OF THE PREFERRED EMBODIMENTS

Embodiments according to the present invention will now be described taking a case of a discharger of static electricity.

Figure 1:
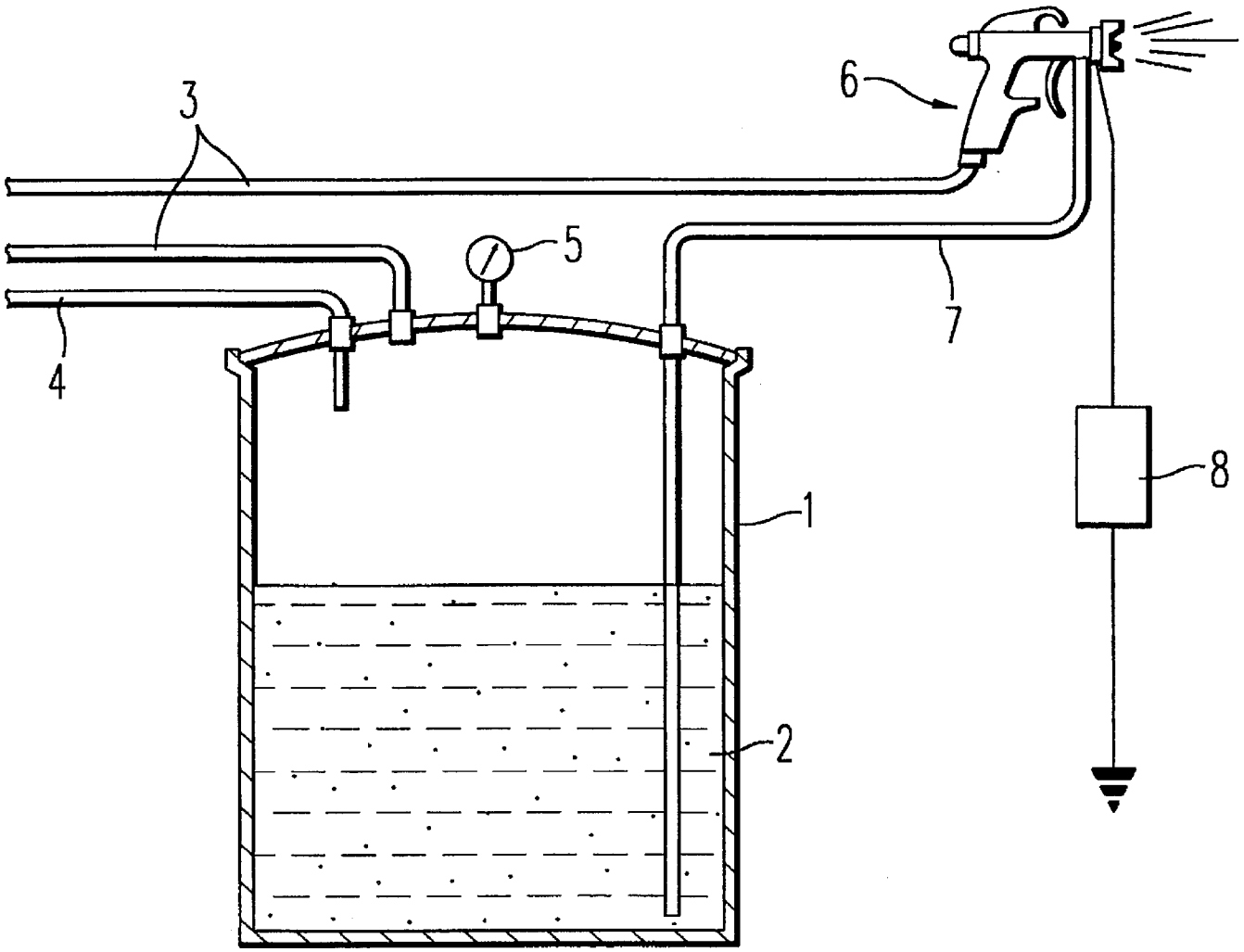
FIG. 1 schematically shows an apparatus for storing a conductive liquid in an electric insulating vessel and for atomizing and ionizing the liquid while directly applying a high voltage to the liquid storage system.

Referring to FIG. 1, a water vapor ionizing apparatus according to a first embodiment of the invention is shown. A conductive liquid 2 such as water is supplied to an electrically insulating, e.g., plastic, vessel 1 via a supply pipe 4. The conductive liquid 2 is pressurized by compressed air supplied by the compressed air supplied pipe 3. The air pressure may be read by the pressure gauge 5.

The air pressure within the vessel 1 forces the conductive liquid through the supply pipe 7 to the spray gun 6, from which the conductive liquid can be sprayed as an atomized mist onto an object to be discharged. The conductive liquid forming the mist is directly ionized by a high voltage applied to the spray gun of the liquid storage system by the high voltage power supply 8, for example an AC voltage of 2–20 Kv at 40–60 Hz. Although the conductive liquid is directly ionized by a high voltage directly applied to a stored liquid system, the voltage drop is kept to a minimum since liquid supply pipe 4 is insulated from a stored liquid surface by utilizing the electric insulation characteristics of air.

Figure 2A:
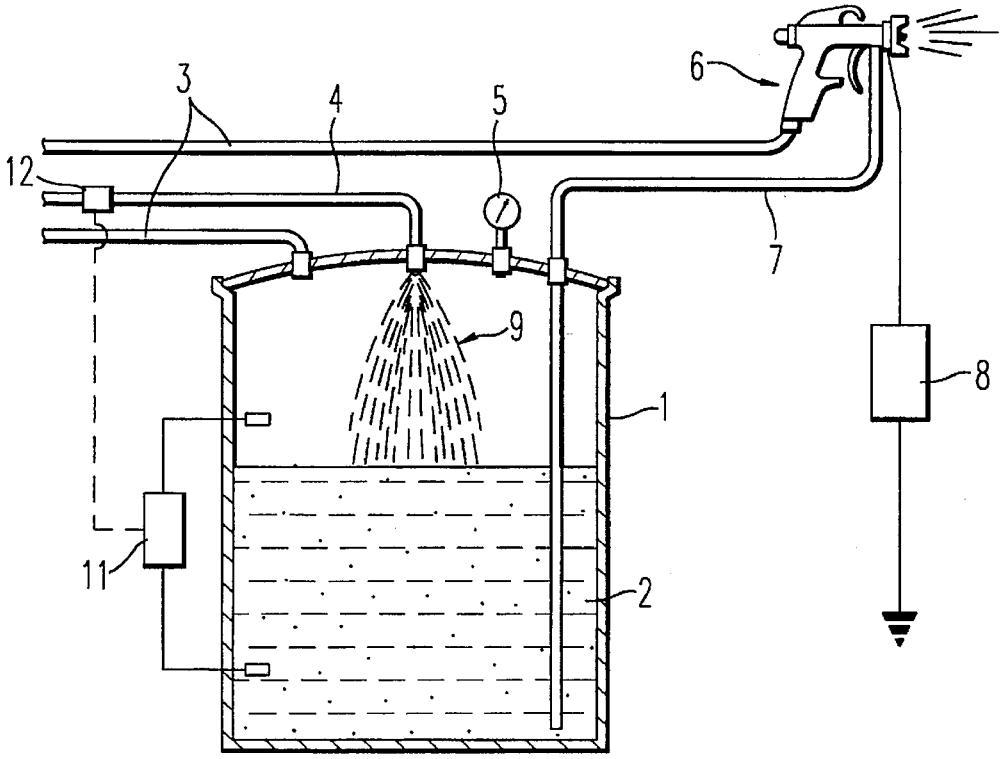
FIGS. 2*a* and 2*b* show two examples for atomizing or forming a conductive liquid into droplets to supply it to an electric insulating vessel.
Figure 2B:
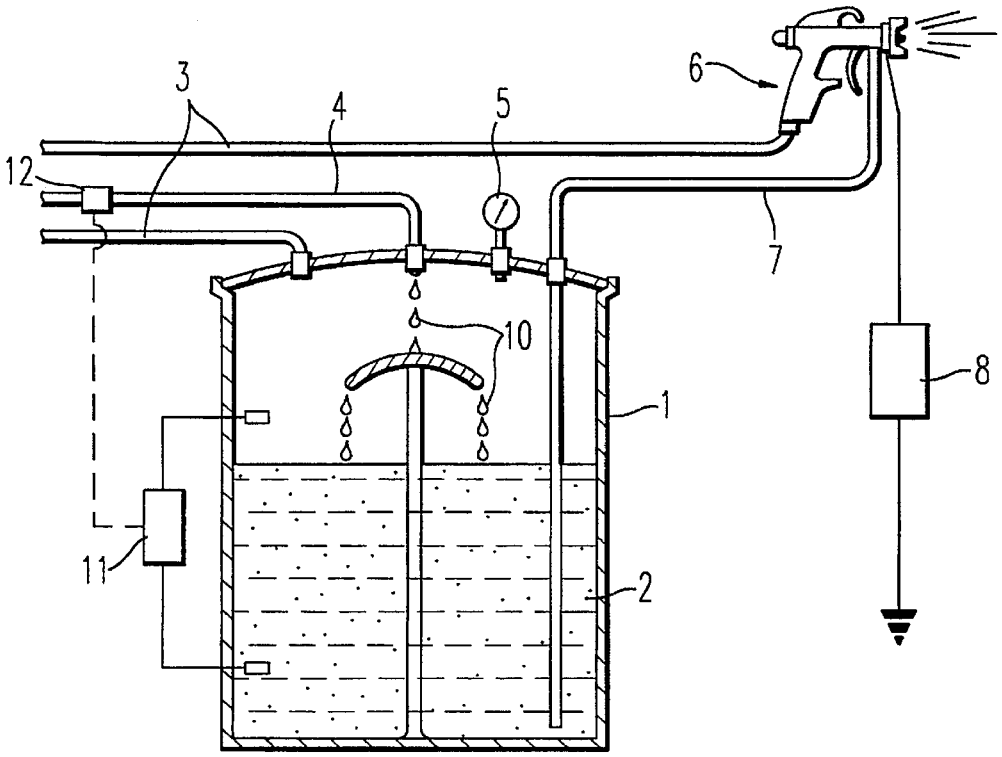

In the embodiment of FIG. 2(*a*), which is the same as that of FIG. 1 except as noted below, the liquid supply pipe 4 terminates in a nozzle so that the conductive liquid is supplied as a fine mist or spray 9 onto the surface of the reservoir of conductive liquid already within the vessel. A liquid level sensor 11 controls a flow rate controller in the pipe 4 so that the conductive liquid level maintains a level within a desired range.

In FIG. 2(*b*), rather than providing a nozzle which produces a fine spray 9 of atomized conductive liquid, droplets 10 of conductive liquid fall from the port of the pipe 4 onto a spreader which spreads the droplets in the vessel. In both of these embodiments, the voltage drop is kept to a minimum since liquid supply pipe 4 is insulated from a stored liquid.

Figure 3:
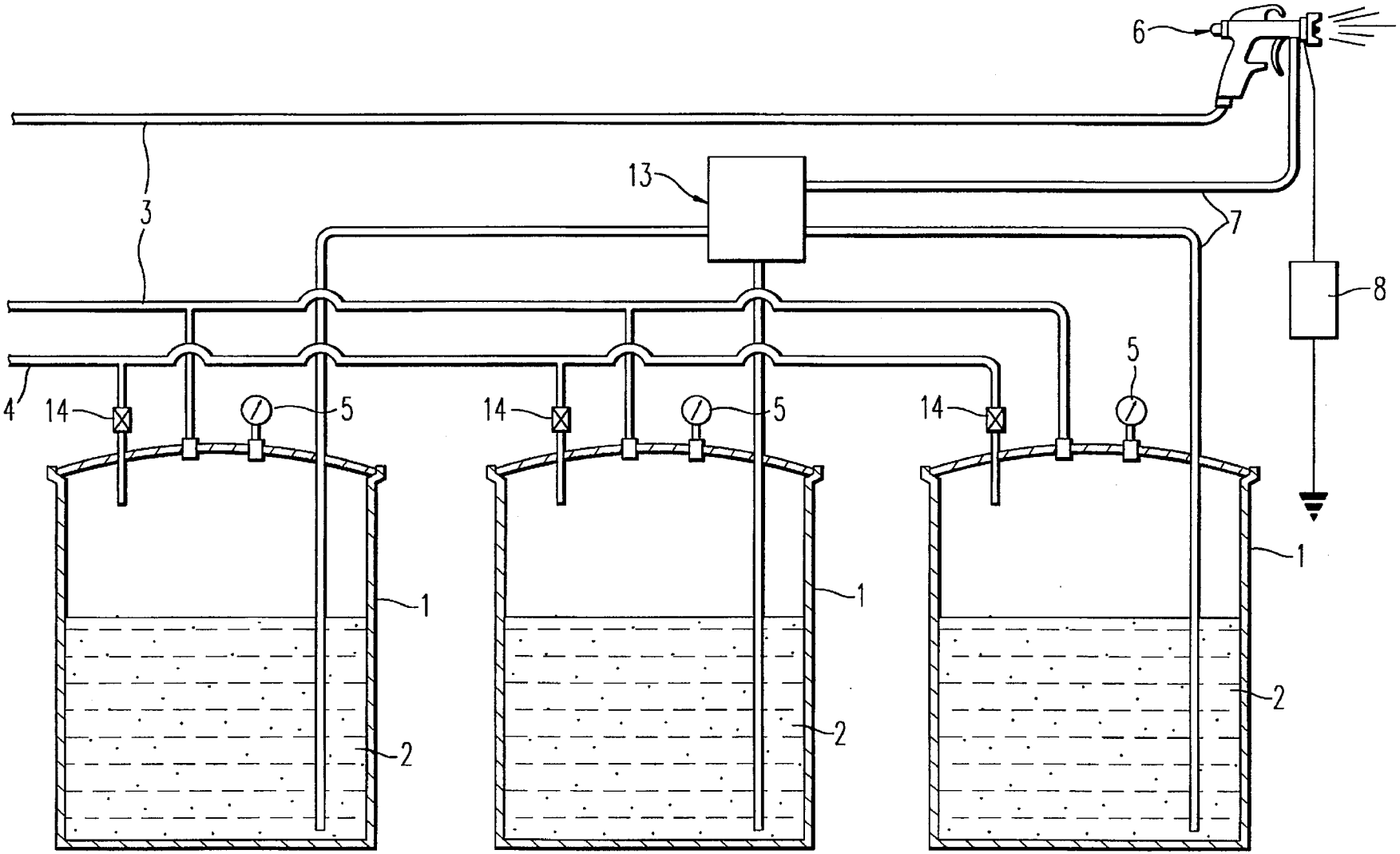
FIG. 3 shows a system for storing conductive liquids in a plurality of electric insulating vessels, including a separator which may be switched as necessary to supply a conductive liquid.

In FIG. 3, several vessels 1 are supplied with conductive liquid through supply pipes having cocks 14. The supply pipes 7 from the individual vessels 1 feed the spray gun 6 via a separator 13 which can selectively connect the vessels to the spray gun. In each embodiment, the conductive liquid is supplied as droplets or a mist from a point electrically insulated from the reservoir of conductive liquid by air.

EXAMPLE

A polyethylene plate and a rigid polyvinyl chloride plate were rubbed so as to be charged to 5 Kv to form an article to be discharged. City water (having an electric resistance of from $10^2$ to $10^4$ Ω·m) was regarded as a conductive liquid 2. The conductive liquid 2 was atomized and ionized by applying a voltage of AC 5 Kv, and was sprayed on the article to be discharged. A complete (100%) discharge was attained. In this case, the conductive liquid 2 was stored in a plastic electric insulating vessel 1, and a sprayer device 6 made of plastic was used. Measurement of the charge of the charged article was made by the Faraday Cage method. A vapor effective arrival distance was 1 m, and a charge density was $10^{-9}/cm^3$ coulomb (c).

In a conventional discharger for ionizing and irradiating air, an effective irradiation distance is short, and when a moving speed of an article to be irradiated exceeds 30 cm/sec, the discharge effect almost disappears. On the other hand, in a system for atomizing and ionizing a conductive liquid and spraying the ionized mist according to the present invention, an ion concentration (a charge density) is large, and the effective range of the vapor is also large, 1 m.

Accordingly, when charged articles move at a certain speed in the production or processing of plastic film, plastic molding, synthetic fibers, semiconductors, printing processes, IC packaging, transportation systems and packaging, freedom for positioning a discharger, which has been heretofore limited, can be extended. Further, since city water can be used as a conductive liquid, the article to be sprayed is not contaminated, and the cost is low.

Since a method is employed in which a conductive liquid having been atomized and formed into droplets is supplied to a storage vessel, a liquid supply port is insulated from a stored liquid surface by utilizing the electric insulation characteristics of air, and so no voltage drop occurs even if a high voltage is directly applied to a stored liquid system. Further, safety is secured, and a discharger can be used continuously. The same is applied to the use of a conductive coating by an electrostatic coating system.

Obviously, numerous modifications and variations of the present invention are possible in light of the above teachings. It is therefore to be understood that the invention may be practiced otherwise than as specifically described herein.

What is claimed as new and desired to be secured by Letters Patent of the United States is:

1. A vapor ionizing apparatus for ionizing water, comprising:

an electrically insulating vessel containing a reservoir of water;

means for atomizing water from said reservoir; and means for applying an AC voltage of 2 to 20 Kv to the water in said atomizing means such that the water is simutaneously ionized and atomized.

2. The apparatus of claim 1 wherein said means for applying a voltage to the water in said atomizing means comprise means for applying a voltage to said atomizing means.

3. The apparatus of claim 2 wherein said atomizing means comprises a spray gun and said means for applying a voltage to said atomizing means comprises a voltage power supply operatively connected to said spray gun.

4. A vapor ionizing apparatus for ionizing water, comprising:

an electrically insulating vessel containing a reservoir of water;

means for supplying water to said vessel such that the water in said supplying means is electrically insulated from the water in the reservoir by air;

means for atomizing water from said reservoir; and means for applying an AC voltage of 2 to 20 Kv to the water in said atomizing means.

5. The apparatus of claim 4 wherein said supplying means comprises a water nozzle mounted above a surface of said reservoir for spraying the water into the vessel.

6. The apparatus of claim 4 wherein said supplying means comprises a conductive liquid port mounted above a surface of said reservoir for dripping the water into the vessel.

7. The apparatus of claim 6 wherein said supplying means further comprises a spreader in said vessel for spreading the dripping water.

8. A vapor ionizing apparatus for ionizing water, comprising:

a plurality of electrically insulating vessels, each containing a reservoir of water;

means for supplying water to said vessels such that the water in said supplying means is electrically insulated from the water in the reservoir of each of said vessels;

atomizing means;

means for selectively supplying water from said vessels to said atomizing means; and means for applying an AC voltage of 2 to 20 Kv to the water in said atomizing means.

9. The apparatus of claim 8 wherein said atomizing means comprises a spray gun and said means for selectively supplying conductive liquid from said vessels to said atomizing means includes a separator which can selectively connect water in said vessels to said spray gun.

* * * * *